US011444410B2

(12) United States Patent
Shimizu et al.

(10) Patent No.: US 11,444,410 B2
(45) Date of Patent: Sep. 13, 2022

(54) WATERPROOF STRUCTURE FOR MULTICORE WIRE

(71) Applicant: Sumitomo Wiring Systems, Ltd., Yokkaichi (JP)

(72) Inventors: Moriyuki Shimizu, Yokkaichi (JP); Yukitoshi Terasaka, Yokkaichi (JP); Toshinari Kobayashi, Yokkaichi (JP); Hironobu Yamamoto, Yokkaichi (JP); Kyungwoo Kim, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 17/251,984

(22) PCT Filed: May 30, 2019

(86) PCT No.: PCT/JP2019/021524
§ 371 (c)(1),
(2) Date: Dec. 14, 2020

(87) PCT Pub. No.: WO2019/239910
PCT Pub. Date: Dec. 19, 2019

(65) Prior Publication Data

US 2021/0249809 A1 Aug. 12, 2021

(30) Foreign Application Priority Data

Jun. 15, 2018 (JP) ..... JP2018-114192

(51) Int. Cl.
*H01R 13/52* (2006.01)
*H01B 7/282* (2006.01)

(52) U.S. Cl.
CPC ..... *H01R 13/521* (2013.01); *H01B 7/2825* (2013.01); *H01R 13/5208* (2013.01)

(58) Field of Classification Search
CPC .... H01R 13/521; H01R 13/516; H01R 13/52; H01R 13/46; H01R 13/5208; H01B 7/2825
(Continued)

(56) References Cited

U.S. PATENT DOCUMENTS 4,492,421 A * 1/1985 Ito ..... H01B 17/30 439/271
5,580,264 A * 12/1996 Aoyama ..... H01R 13/5208 439/275
5,873,737 A * 2/1999 Hashizawa ..... H01R 13/62933 439/39
(Continued)

FOREIGN PATENT DOCUMENTS

JP 2011-046331 A 3/2011
JP 2014-241192 A 12/2014
(Continued)

OTHER PUBLICATIONS

International Search Report, Application No. PCT/JP2019/021524, dated Aug. 6, 2019. ISA/Japan Patent Office.

*Primary Examiner* — Harshad C Patel
(74) *Attorney, Agent, or Firm* — Honigman LLP

(57) ABSTRACT

Provided is a waterproof structure for a multicore wire capable of enhancing waterproofness. The waterproof structure includes a multicore wire in which a plurality of core wires are housed in a sheath, a housing in which is housed a terminal fitting connected to a terminal portion of the core wires, and in which is formed an opening through which the core wires are externally extracted, a molded part covering the opening and covering an end face of the sheath, and a resin stopper part disposed on an inner side of the molded part inside the opening.

12 Claims, 6 Drawing Sheets

(58) Field of Classification Search
USPC ..... 439/271, 274, 275, 279, 371, 623–625; 174/77 R
See application file for complete search history.

(56) References Cited

U.S. PATENT DOCUMENTS

| | | | | |
|---|---|---|---|---|
| 5,897,396 | A * | 4/1999 | Maejima | H01R 13/5208 439/587 |
| 6,196,873 | B1 * | 3/2001 | Murakami | H01R 13/502 439/595 |
| 6,676,447 | B1 * | 1/2004 | Knox | H01R 13/523 439/274 |
| 6,821,160 | B2 * | 11/2004 | Fink | H01R 13/512 439/595 |
| 6,971,905 | B2 * | 12/2005 | Makita | H01R 13/5205 439/447 |
| 7,004,789 | B2 * | 2/2006 | Kameyama | H01R 13/5216 439/274 |
| 7,104,840 | B2 * | 9/2006 | Murakami | H01R 13/6277 439/272 |
| 8,529,273 | B2 * | 9/2013 | Maegawa | H01R 13/5227 439/34 |
| 9,893,454 | B2 * | 2/2018 | Tomita | H01R 13/4367 |
| 10,305,215 | B2 * | 5/2019 | Tomita | H01R 13/504 |
| 10,797,432 | B2 * | 10/2020 | Takagi | H01R 13/5205 |
| 2002/0177351 | A1 * | 11/2002 | Kihira | H01R 13/5833 439/468 |
| 2008/0032544 | A1 * | 2/2008 | Tsuji | H01R 13/56 439/470 |
| 2008/0280467 | A1 * | 11/2008 | Tsuji | H01R 13/567 439/135 |
| 2012/0100752 | A1 * | 4/2012 | Ooki | H01R 13/504 439/588 |
| 2013/0105219 | A1 * | 5/2013 | Osawa | H01R 13/5208 174/77 R |
| 2016/0056590 | A1 * | 2/2016 | Sugiyama | H01R 13/5202 439/277 |
| 2016/0336097 | A1 * | 11/2016 | Sakagami | H02G 15/013 |
| 2017/0154706 | A1 * | 6/2017 | Yamamoto | H01B 7/285 |
| 2020/0368948 | A1 * | 11/2020 | Kim | B29C 45/0005 |
| 2021/0257823 | A1 * | 8/2021 | Kim | H01B 7/02 |

FOREIGN PATENT DOCUMENTS

| | | | |
|---|---|---|---|
| JP | 2016-184542 | A | 10/2016 |
| JP | 2017-016783 | A | 1/2017 |

* cited by examiner

WATERPROOF STRUCTURE FOR MULTICORE WIRE

CROSS-REFERENCE TO RELATED APPLICATIONS

This application is the U.S. national stage of PCT/JP2019/021524 filed on May 30, 2019, which claims priority of Japanese Patent Application No. JP 2018-114192 filed on Jun. 15, 2018, the contents of which are incorporated herein.

TECHNICAL FIELD

The present disclosure relates to a waterproof structure for a multicore wire.

BACKGROUND

Conventionally, as a structure for waterproofing a terminal portion of a multicore wire in which a plurality of core wires are enclosed with a sheath, a structure using a heat shrinkable tube, such as described in the following JP 2016-184542A, for example, is known. At the terminal portion of a multicore wire, the core wires are exposed from the sheath, a terminal fitting is connected to each core wire, and the terminal fitting is housed in a connector.

An end portion of the sheath is covered with a heat shrinkable tube. The shrunk heat shrinkable tube diameter-reduces the sheath and blocks gaps inside the sheath. Also, hot melt on the inner surface of the heat shrinkable tube melts and fills minute gaps inside the sheath. The terminal portion of the multicore wire is thereby waterproofed.

However, in order to further enhance the waterproofness in a configuration such as the above, the minute gaps inside the sheath need to be completely filled. Since it is not easy to completely fill the gaps inside the sheath, enhancing the waterproofness is difficult.

The present disclosure has been accomplished based on circumstances such as the above, and an object thereof is to provide a waterproof structure for a multicore wire that is capable of enhancing waterproofness.

SUMMARY

A waterproof structure for a multicore wire of the present disclosure includes a multicore wire in which a plurality of core wires are housed in a sheath, a housing in which is housed a terminal fitting connected to a terminal portion of the core wires, and in which is formed an opening through which the core wires are externally extracted, a molded part covering the opening and covering an end face of the sheath, and a resin stopper part disposed on an inner side of the molded part inside the opening.

Advantageous Effects of Disclosure

According to the present disclosure, the opening of the housing and the end face of the sheath are waterproofed by the molded part, thus enabling waterproofness to be enhanced.

DETAILED DESCRIPTION OF PREFERRED EMBODIMENTS

Figure 1:
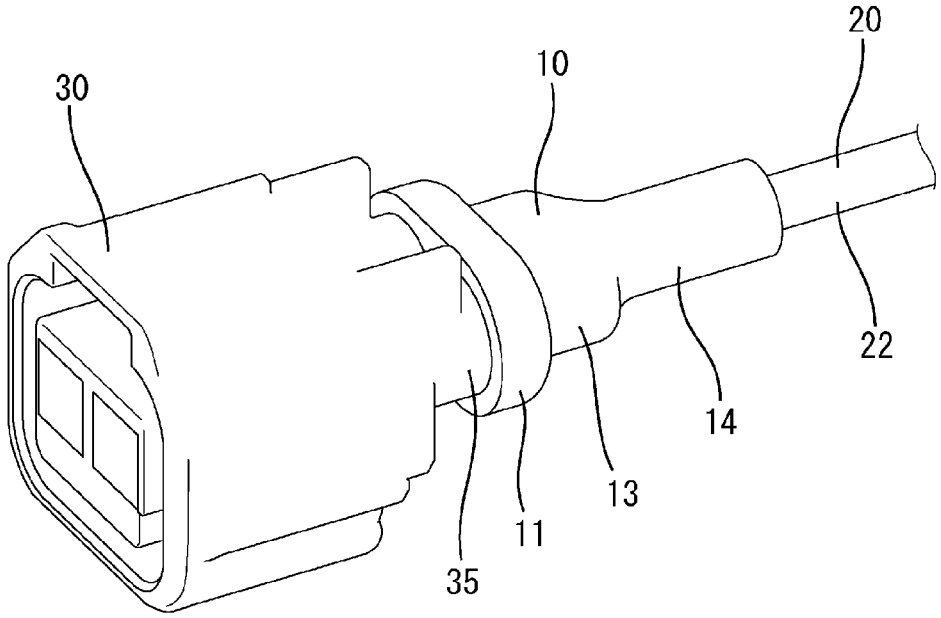
FIG. 1 is a perspective view showing a waterproof structure for a multicore wire in Embodiment 1.

Preferred modes of the present disclosure will be illustrated below.

The waterproof structure for a multicore wire of the present disclosure may be configured such that a melt part that melts during molding of the molded part is provided along an outer edge of the opening. According to such a configuration, the melt part melts and intimately contacts the molded part, thus enabling waterproofness to be further enhanced.

Also, the waterproof structure for a multicore wire of the present disclosure may be configured such that the molded part includes a bent part that holds the multicore wire in a bent shape. According to such a configuration, dedicated components for holding the multicore wire in the bent shape need not be used, thus enabling the number of components to be reduced.

Also, the waterproof structure for a multicore wire of the present disclosure may be configured such that the molded part includes an outer circumferential part covering an outer circumferential surface of the housing. According to such a configuration, the molded part is securely integrated with the housing, thus enhancing durability.

Also, the waterproof structure for a multicore wire of the present disclosure may be configured such that the resin stopper part is an existing rubber plug. According to such a configuration, dedicated components for stopping the resin during molding of the molded part need not be newly manufactured, thus enabling an increase in cost to be prevented.

Also, the waterproof structure for a multicore wire of the present disclosure may be configured such that a stopper surface opposing a surface on an inner side of the resin stopper part is formed in the housing. According to such a configuration, in the case where the resin stopper part is a rubber plug, the rubber plug can be prevented from excessively entering the inner side due to pressure that occurs when molding the molded part.

Embodiment 1

Hereinafter, Embodiment 1 embodying the present disclosure will be described in detail, with reference to FIGS. 1 to 6.

The waterproof structure for a multicore wire in the present embodiment is a structure that uses a molded part 10 to waterproof the terminal portion of a multicore wire 20 in which a plurality (two in the present embodiment) of core wires 21 are integrated by being collectively enclosing with a sheath 22. The molded part 10 is provided to span from a housing 30 to the sheath 22 by insert molding or the like. The molded part 10 will be described in detail later.

Figure 2:
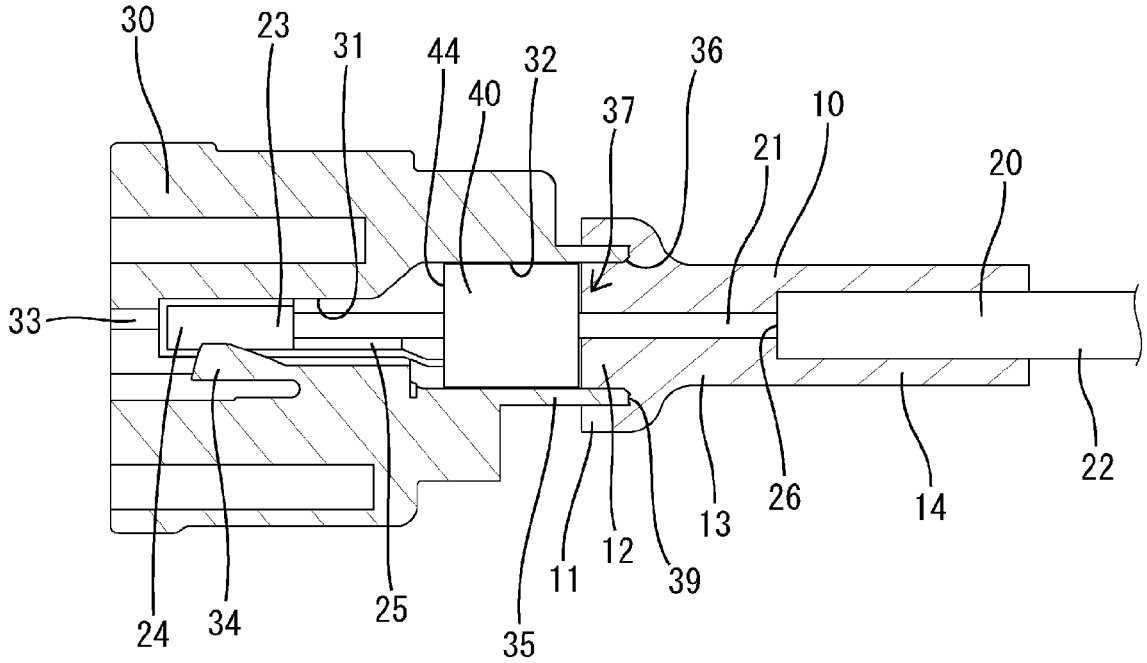
FIG. 2 is a cross-sectional view showing the waterproof structure for a multicore wire.
Figure 3:
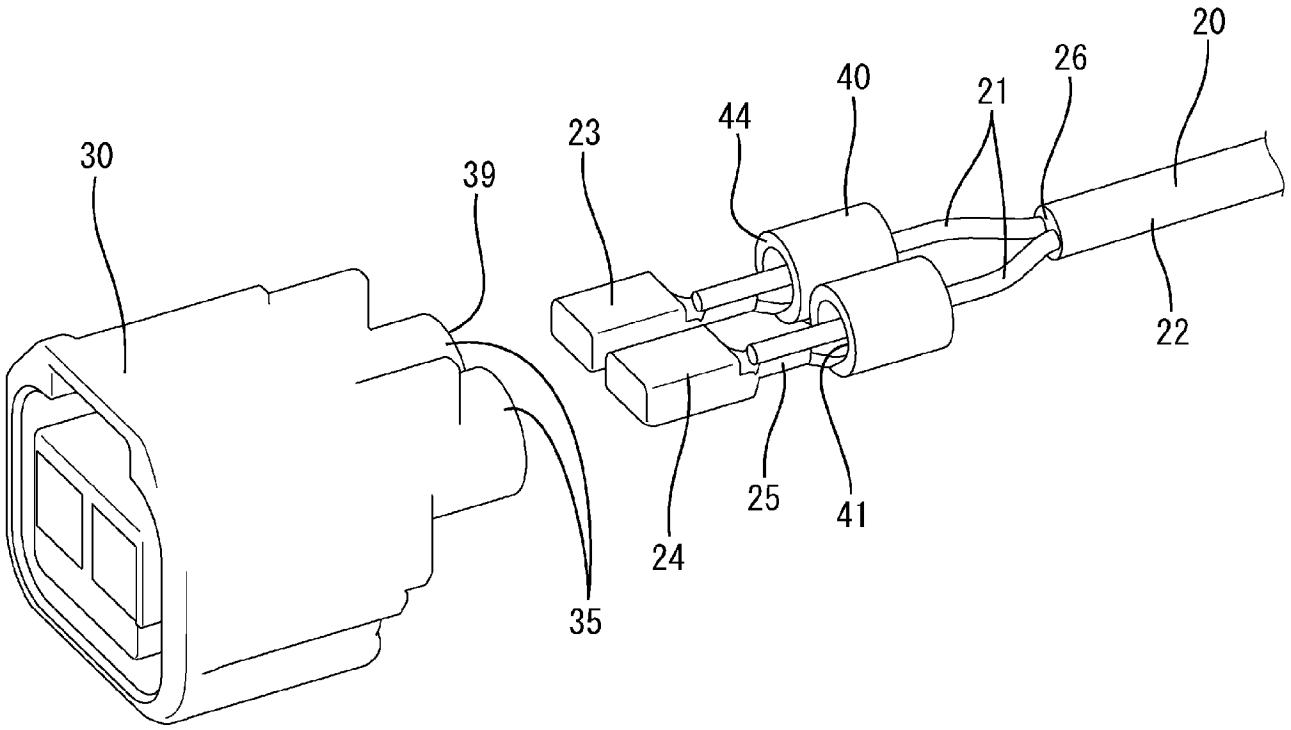
FIG. 3 is a perspective view showing a housing and a terminal portion of a multicore wire.

The sheath 22 is made of a thermoplastic resin (thermoplastic urethane, etc.), and insulates and protects the two core wires 21. The core wires 21 are covered wires, and, as shown in FIG. 3, a terminal fitting 23 is connected to the terminal portion of each core wire 21. The terminal fitting 23 is a female terminal fitting 23 and has a box-shaped terminal main body 24, and is electrically connected to a male terminal fitting (not shown) by the male terminal fitting being inserted into the terminal main body 24. The terminal fitting 23 is provided with a connecting part 25 that is connected by crimping to the terminal portion of the core wire 21. The terminal fitting 23 is inserted inside the housing 30 and retained, as shown in FIG. 2. Hereinafter, with each constituent member, the front side (left side in FIG. 2) in the insertion direction of the terminal fitting 23 into the housing 30 will be described as forward, and the opposite side thereto (right side in FIG. 2) will be described as rearward.

The housing 30 is made of a synthetic resin such as nylon or polybutylene terephthalate (PBT), for example, and has formed therein terminal housing parts 31 in which the terminal fittings 23 connected to the terminal portion of the core wires 21 are housed, and openings 32 through which the core wires 21 are externally extracted. This housing 30 constitutes a female connector in which the female terminal fittings 23 are housed.

Figure 6:
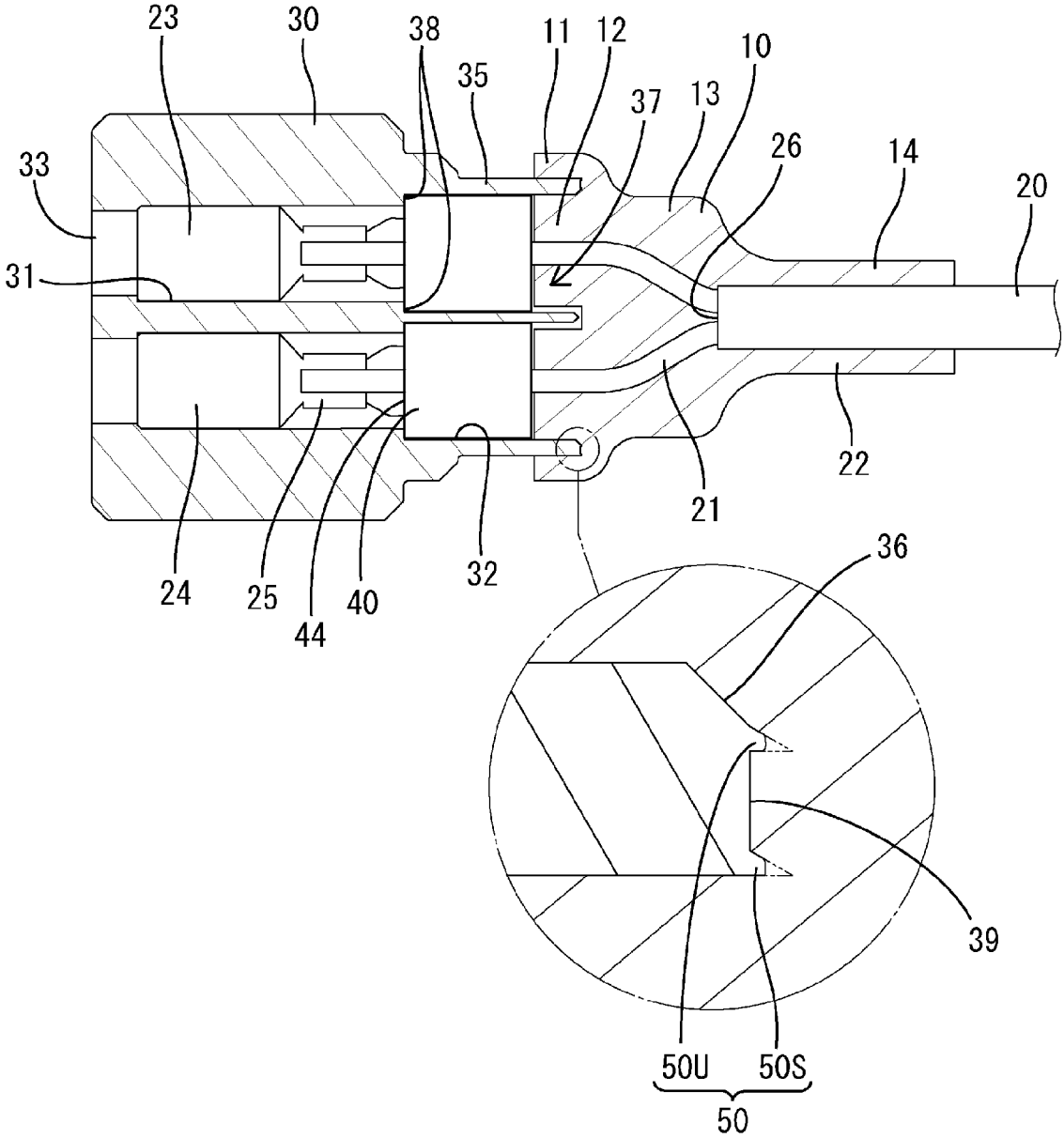
FIG. 6 is a cross-sectional view showing a different cross-section of the waterproof structure for a multicore wire from FIG. 2.

Two terminal housing parts 31 corresponding to the number of the terminal fittings 23 are provided to be arranged side by side, as shown in FIG. 6. Through the front end of each terminal housing part 31 is formed a tab insertion slot 33 into which a tab portion of an opposing terminal fitting is inserted, as shown in FIG. 2. Also, a lance 34 that latches onto the terminal fitting 23 and retains the terminal fitting 23 is provided in each terminal housing part 31. The lance 34 has a cantilever-like form extending forward from the inner wall of the terminal housing part 31

Figure 4:
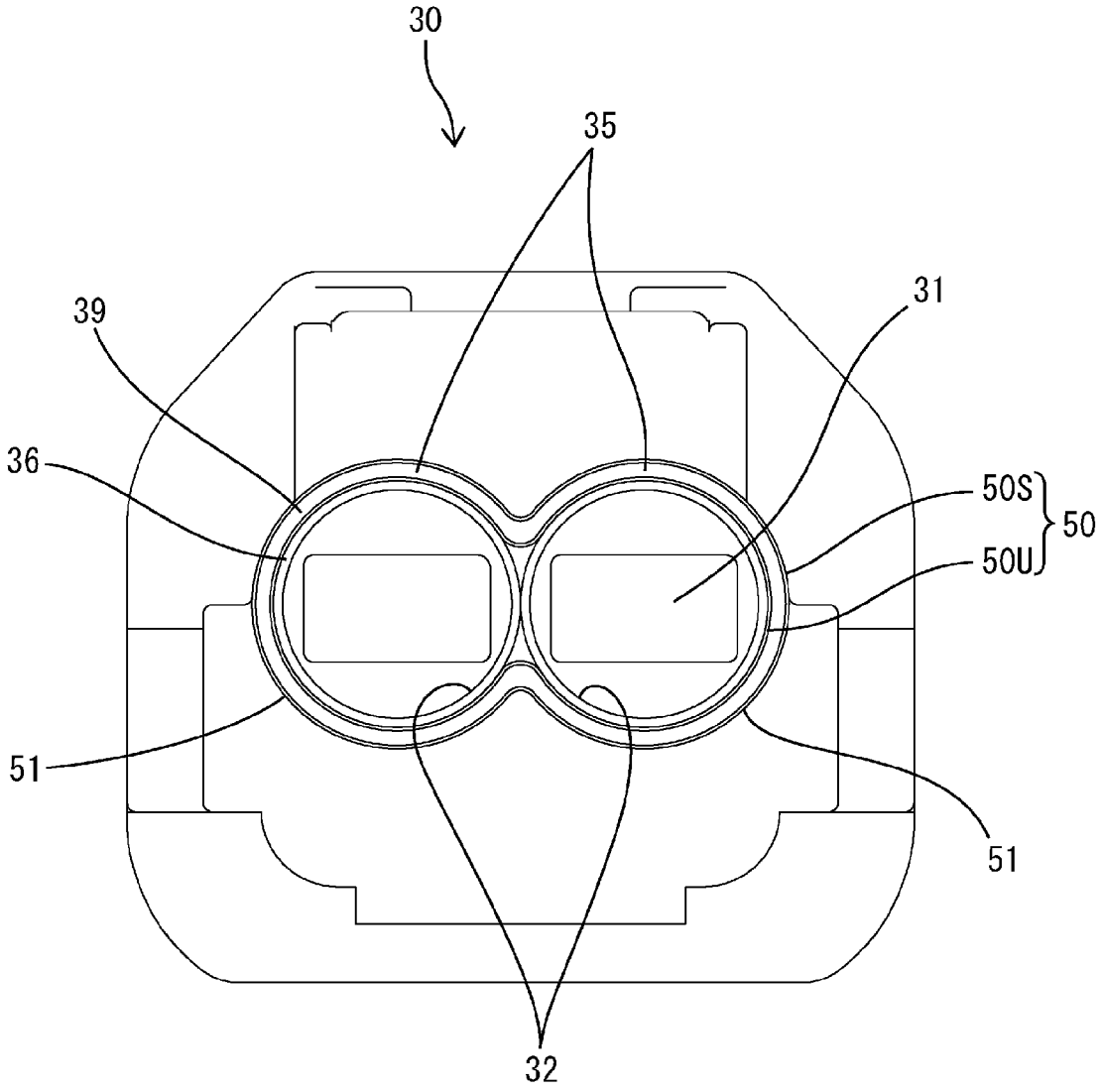
FIG. 4 is a rear view showing the housing.

The openings 32 run into the rear side of the respective terminal housing parts 31. The circumferential surface of the openings 32 is a circular arc surface, and, as shown in FIG. 4, the openings individually open rearward for each terminal housing part 31.

The openings 32 are formed in tower parts 35 having a cylindrical shape provided on the rear end portion of the housing 30 (refer to FIG. 3). Two tower parts 35 are provided to be arranged side by side. The adjacent tower parts 35 are joined in the arrangement direction (refer to FIG. 4).

Figure 5:
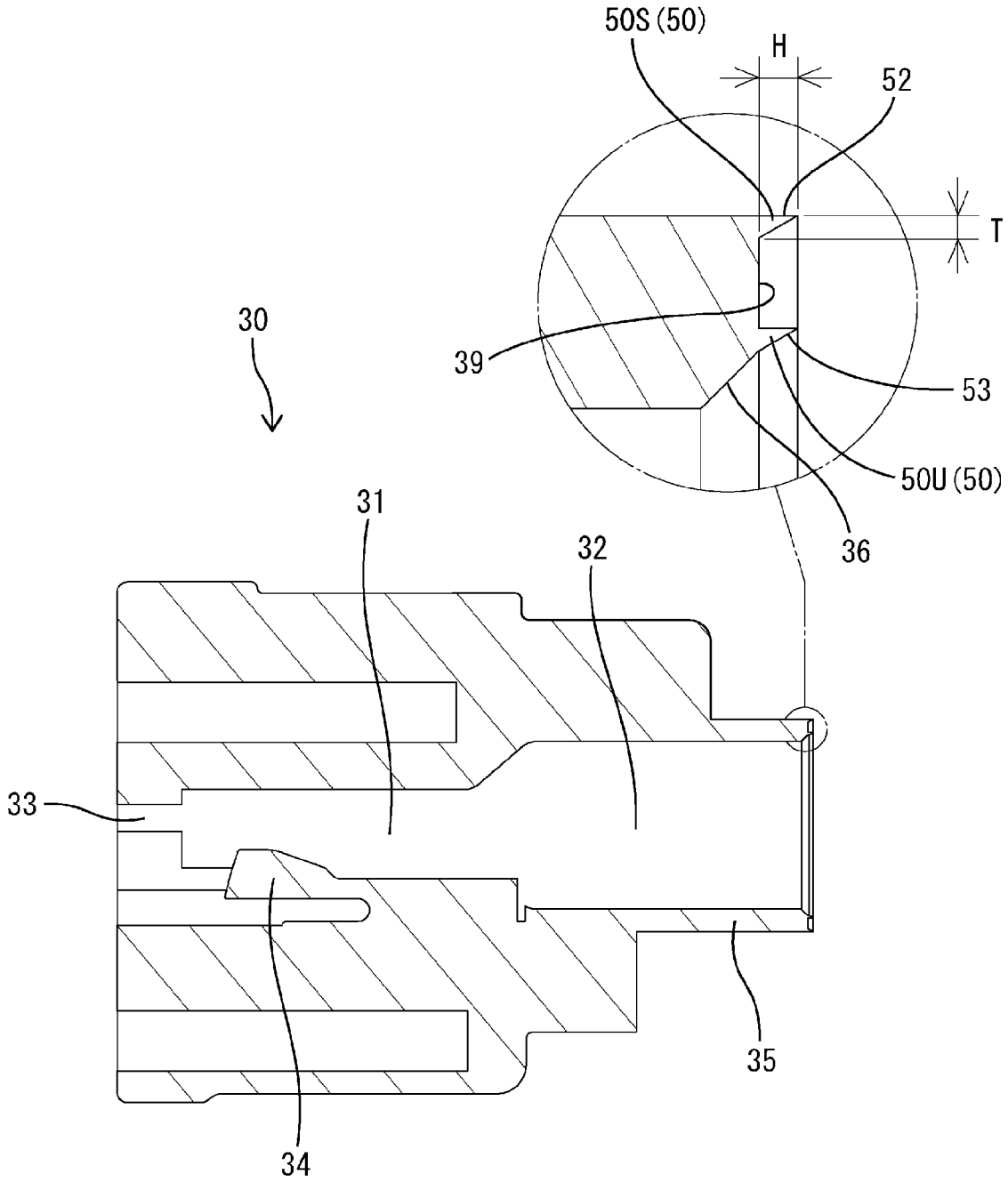
FIG. 5 is a cross-sectional view showing the housing.

In a rear end portion of each tower part 35 is formed a tapered surface 36, as shown in FIG. 5. The tapered surface 36 is formed on the inner circumferential side of each tower part 35, and slopes such that the inner diameter decreases in the forward direction.

A resin stopper part 40 is disposed in the openings 32, as shown in FIG. 6. The resin stopper part 40 is located on the front side (inner side) of the molded part 10. The resin stopper part 40 is an existing individual rubber plug, and is individually fitted into the opening 32 of the tower parts 35. The resin stopper part 40 has a cylindrical shape in the middle of which is formed a through hole 41 into which the core wires 21 are inserted, as shown in FIG. 3, and a plurality of lips (not shown) are respectively formed on the inner circumferential surface and outer circumferential surface of each resin stopper part 40. The inner circumferential surface of the resin stopper parts 40 intimately contacts the outer circumferential surface of the respective core wires 21 in a liquid tight manner, and the outer circumferential surface of the resin stopper parts 40 intimately contacts the circumferential surface of the respective openings 32 (inner circumferential surface of the respective tower parts 35) in a liquid tight manner.

The front and rear faces of each resin stopper part 40 are generally orthogonal to the front-rear direction, as shown in FIG. 6. The size of each resin stopper part 40 in the front-rear direction is configured to be smaller than the size of each tower part 35 in the front-rear direction. In a state before the molded part 10 is molded, a space 37 that opens rearward is formed in a rear end portion of each tower part 35 (rear side of the resin stopper part 40).

A stopper surface 38 opposing a front surface (surface on the inner side) 44 of the resin stopper part 40 is formed inside the housing 30, as shown in FIG. 6. The stopper surface 38 is approximately orthogonal to the front-rear direction, and the front surface 44 of the resin stopper part 40 abuts therewith. The stopper surface 38 abuts a portion on both sides of the front surface 44 of the resin stopper part 40 (both ends in the radial direction) with the through hole 41 therebetween.

A melt part 50 whose tip portion melts during molding of the molded part 10 is provided on the rear end portion of the housing 30. The melt part 50 is a rib protruding on a rear surface 39 of the housing 30. Due to the melt part 50 being formed on the rear surface 39 of the housing 30, the need for a slide mold can be obviated, and molding of the housing 30 can be simplified.

The melt part 50 has a triangular cross-sectional shape in which the protruding end side is pointed in a state before melting due to the molding heat of the molded part 10 (hereinafter referred to as a first state), as shown in FIG. 5, and the tip portion melts with the molding heat, in a state after melting due to the molding heat of the molded part 10 (hereinafter referred to as a second state), as shown in FIG. 6.

The melt part 50 is provided along an outer edge of each tower part 35, and encloses the entire circumference of the opening 32, as shown in FIG. 4. The melt part 50 has a form in which portions (hereinafter referred to as circular arc parts 51) having a circular arc shape along the outer edge of each tower part 35 are arranged side by side. The two circular arc parts 51 are joined at a central portion in the arrangement direction. Specifically, each circular arc part 51 forms a partially open C-shape, with both ends of the open portions of the circular arc parts 51 being joined, and the two openings 32 being collectively encircled.

The melt part 50 is provided twofold around the openings 32. The outer melt part 50 (hereinafter referred to as an outer melt part 50S) and the inner melt part 50 (hereinafter referred to as an inner melt part 50U) of the melt part 50 are disposed approximately parallel with a predetermined interval therebetween. The outer melt part 50S extends along an outer edge of the rear surface 39 of the tower parts 35, and the inner melt part 50U extends along an inner edge of the rear surface 39 of the tower parts 35.

Each melt part 50 is configured such that, in the first state, a height size H from the rear surface 39 of the housing 30 to the tip is greater than a thickness size (size in the radial direction of the tower part 35) T at the base position. Also, each melt part 50 is formed in a tapered shape that narrows toward the tip.

Each melt part 50 is provided with a vertical face 52 and a sloping face 53 that slopes with respect to the vertical face 52. The interior angle of the vertical face 52 and the sloping face 53 is smaller than 45 degrees. The vertical face 52 of the outer melt part 50S runs along the outer circumferential surface of the tower part 35, and is approximately perpendicular to the rear surface 39 of the housing 30. The sloping face 53 of the inner melt part 50U runs into the tapered surface 36 formed on the rear end portion of the tower part 35.

Note that the outer melt part 50S and the inner melt part 50U are configured such that, in the first state, the thickness sizes T and the height sizes H are equal.

The molded part 10 provided to span from the housing 30 to the sheath 22 is made of the same type of synthetic resin as the housing 30, and favorably fuses to the housing 30. The molded part 10 completely covers the entire exposed portion of the core wires 21, the openings 32 and the end face 26 of the sheath 22, as shown in FIG. 2. Gaps between the openings 32 of the housing 30 and the end face 26 of the sheath 22 are thereby water-stopped.

The molded part 10, as shown in FIG. 2, is provided with an outer circumferential part 11 that covers the outer circumferential surface of the housing 30, an inner circumference part 12 disposed on the inner circumferential side of the tower parts 35, an intermediate part 13 disposed between the housing 30 and the sheath 22, and a sheath enclosing part 14 that encloses the sheath 22.

The outer circumferential part 11 covers the entire circumference of the rear end portion of the housing 30 (rear end portion of the tower parts 35). The outer circumferential part 11 covers the outer side of a region corresponding to the space 37 of each tower part 35. The outer circumferential part 11 intimately contacts the outer circumferential surface of the housing 30 in a state of fitting onto the outer side of the housing 30.

The inner circumference part 12 encloses each core wire 21, and intimately contacts the entire circumference of the outer circumferential surface of each core wire 21 and the inner circumferential surface of each tower part 35. The front surface of the inner circumference part 12 intimately contacts the rear surface of the resin stopper parts 40 or is in close proximity with a slight gap therebetween.

The intermediate part 13 intimately contacts the entire circumference of the opening 32, the entire end face 26 of the sheath 22 and the entire circumference of the outer circumferential surface of each core wire 21, and completely fills the space between the two core wires 21 (refer to FIG. 6). The sheath enclosing part 14 intimately contacts the entire circumference of the sheath 22. The end face 26 and outer circumferential surface of the sheath 22 melt due to the molding heat of the molded part 10, and fuse to the molded part 10. That is, the interface is eliminated between the molded part 10 and the sheath 22.

The width size (size in the up-down direction in FIG. 6) of the molded part 10 decreases from the front side to the rear side, that is, in order of the outer circumferential part 11, the intermediate part 13, and the sheath enclosing part 14.

The height size (size in the up-down direction in FIG. 2) of the molded part 10 is largest at the outer circumferential part 11, smaller at the intermediate part 13, and uniform from there to the rear end of the sheath enclosing part 14.

The thickness size of the molded part 10 is largest at the intermediate part 13. That is, the thickness size of the portion enclosing each core wire 21 is greater than the thickness size of the portion enclosing the sheath 22.

Next, an example of a method for manufacturing the waterproof structure for a multicore wire in the present embodiment will be described.

First, individual rubber plugs serving as the resin stopper parts 40 are fitted to the terminal portions of the core wires 21, and the terminal fittings 23 are crimped.

Next, the terminal fittings 23 are housed in the terminal housing parts 31 of the housing 30, and the resin stopper parts 40 are disposed inside the tower parts 35. The terminal fitting 23 is inserted into the opening 32 of each tower part 35 from rearwardly, and is retained by the lance 34 upon reaching a regular position of the terminal housing part 31. Also, the resin stopper parts 40 fitted to the core wires 21 abuts the stopper surface 38 and stops on the inside of the tower part 35.

Next, the housing 30 and the end portion of the sheath 22 are disposed in predetermined positions of a mold, a molding resin that has been heated and melted is injected into the mold, and the molded part 10 is molded. The molding resin enters between the two core wires 21, and enters the space 37 of the tower parts 35. The molding resin that has entered the space 37 is prevented from flowing into the terminal housing parts 31 by the resin stopper parts 40. The outer surface of the sheath 22 is melted by the hot resin material, and hardens in a state of being fused together with the molding resin of the molded part 10. The outer surface of the sheath 22 thereby intimately contacts the molded part 10, the interface between the outer surface of the sheath 22 and the molded part 10 is eliminated, and the infiltration path of liquid to the end face 26 of the sheath 22 is blocked. Also, as shown in FIG. 6, the tip side of the melt part 50 melts, and the melted portion of the melt part 50 hardens in a state of being fused together with the molding resin of the molded part 10. The tip of the melt part 50 thereby intimately contacts the molded part 10, the interface between the housing 30 and the molded part 10 is eliminated in the melt part 50, and the infiltration path of liquid to the openings 32 is blocked.

Manufacture of the waterproof structure for a multicore wire in the present embodiment is thereby completed.

Next, the operation and effects of the present embodiment constituted as illustrated above will be described.

The waterproof structure for a multicore wire of the present embodiment is provided with a multicore wire 20, a housing 30, a molded part 10, and resin stopper parts 40. The multicore wire 20 encloses a plurality of core wires 21 with a sheath 22. The housing 30 houses terminal fittings 23 connected to the terminal portion of the core wires 21, and openings 32 through which the core wires 21 are externally extracted are formed therein. The molded part 10 covers the openings 32, and covers an end face 26 of the sheath 22. The resin stopper parts 40 are disposed on an inner side of the molded part 10 inside the openings 32. According to this configuration, the openings 32 of the housing 30 and the end face 26 of the sheath 22 are waterproofed by the molded part 10, thus enabling waterproofness to be enhanced.

Here, conventionally, known male connectors (in which male terminal fittings are connected to the terminal portion of the electric wires) include molded connectors in which a housing is molded by insert molding in a portion spanning from the electric wires to the terminal fittings and the wire terminal portion is waterproofed. However, since the housing of the female connectors (in which female terminal fittings are connected to the terminal portion of the electric wires) has an intricate shape, molded connectors such as male connectors are difficult to manufacture. According to the waterproof structure for a multicore wire of the present embodiment, by molding the molded part 10 between the housing 30 and the sheath 22, a waterproof structure similar to the molded connectors of male connectors can be formed for the female connectors, and reliably waterproofed.

Also, in the waterproof structure for a multicore wire of the present embodiment, the melt part 50 that melts during molding of the molded part 10 is provided along the outer edge of the openings 32. According to this configuration, the melt part 50 melts and intimately contacts the molded part 10, thus enabling waterproofness to be further enhanced.

Also, the molded part 10 is provided with an outer circumferential part 11 that covers the outer circumferential surface of the housing 30. According to this configuration, the molded part 10 is securely integrated with the housing 30, thus enabling durability to be enhanced.

Also, the resin stopper parts 40 are existing rubber plugs. According to this configuration, dedicated components for stopping the resin during molding of the molded part 10 need not be newly manufactured, thus enabling an increase in cost to be prevented.

Also, a stopper surface 38 opposing the front surface 44 of the resin stopper parts 40 is formed in the housing 30. According to this configuration, the resin stopper parts 40 can be prevented from excessively entering the front side due to pressure that occurs when molding the molded part 10.

Embodiment 2

Figure 7:
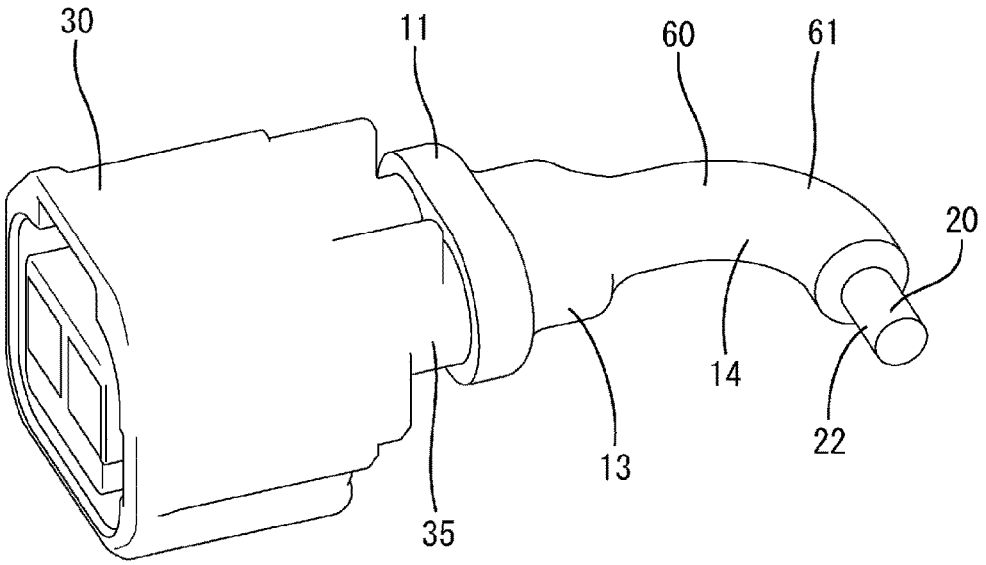
FIG. 7 is a perspective view showing a waterproof structure for a multicore wire in Embodiment 2.
Figure 8:
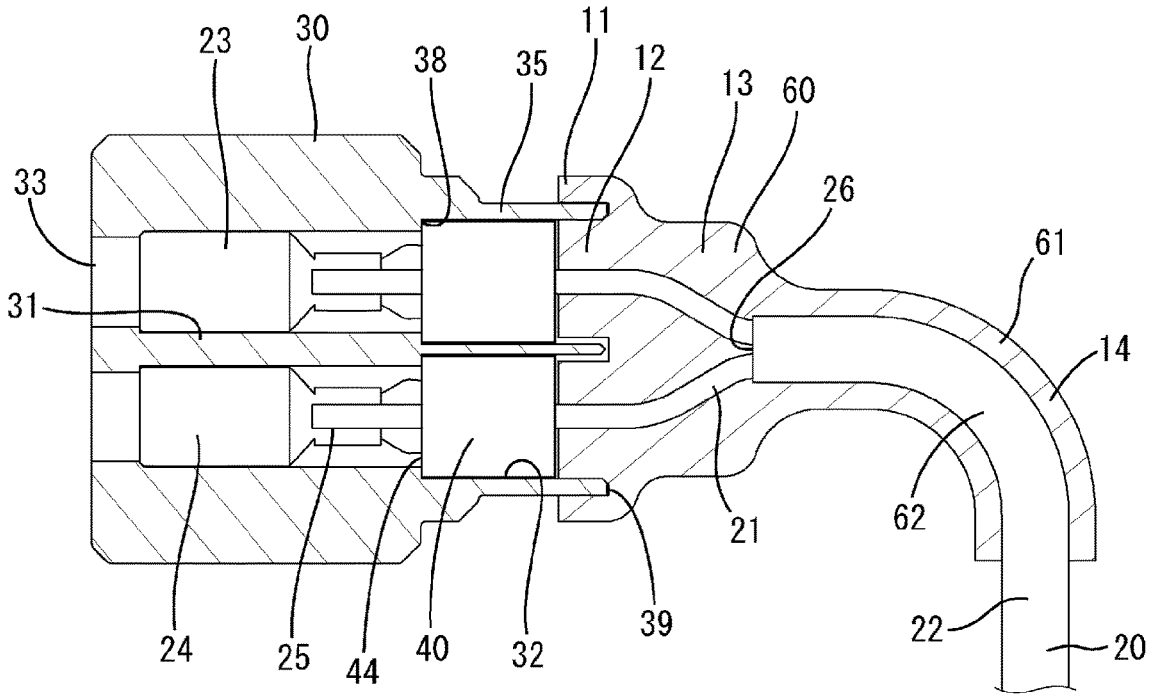
FIG. 8 is a cross-sectional view showing the waterproof structure for a multicore wire.

Next, a waterproof structure for a multicore wire according to Embodiment 2 that embodies the present disclosure will be described using FIGS. 7 and 8.

The waterproof structure for a multicore wire of the present embodiment differs from Embodiment 1 in terms of a molded part 60 having a bent part 61. Note that the same reference signs are given to constituent elements that are similar to Embodiment 1, and redundant description will be omitted.

The waterproof structure for a multicore wire according to the present embodiment is provided with a multicore wire 20, a housing 30, resin stopper parts 40 and a molded part 60, similarly to Embodiment 1. The molded part 60 is provided with an outer circumferential part 11, an inner circumference part 12, an intermediate part 13 and a sheath enclosing part 14, similarly to Embodiment 1.

The molded part 60 has a bent part 61 that bends at generally 90 degrees (approx. perpendicularly to the front-rear direction). The bent part 61 is provided in the sheath enclosing part 14. The portion of the multicore wire 20 that is routed inside the bent part 61 is held in a bent shape by the bent part 61. The multicore wire 20 is thereby held at a state of extending in an approximately perpendicular direction to the housing 30. Note that the degree (angle) to which the bent part 61 is bent can be freely changed.

In the present embodiment as described above, the openings 32 of the housing 30 and the end face 26 of the sheath 22 are waterproofed by the molded part 60, similarly to Embodiment 1, thus enabling waterproofness to be enhanced. Also, according to the present embodiment, since the molded part 60 has the bent part 61, dedicated components for holding the multicore wire 20 in the bent shape need not be used, thus enabling the number of components to be reduced.

Other Embodiments

The present disclosure is not limited to the embodiments illustrated in the description and drawings, and embodiments such as the following, for example, are also included in the technical scope of the disclosure.

In the embodiments, the case where the resin stopper parts 40 are existing rubber plugs was illustrated, but the present disclosure is not limited thereto, and the resin stopper parts need only prevent the molding resin of the molded part from entering the terminal housing part side, and may, for example, be a lid member that closes the openings.

In the above embodiments, the melt part 50 is provided on the housing 30, but the present disclosure is not limited thereto, and the melt part 50 need not be provided, and, for example, a material that fuses to the molded part or the housing may be used.

In the above embodiments, the molded part 10 (60) is provided with the outer circumferential part 11 that covers the entire circumference of the rear end portion of the housing 30, but the present disclosure is not limited thereto, and the outer circumferential part may partially cover the outer circumferential surface of the rear end portion of the housing, or the molded part need not be provided with an outer circumferential part.

In the above embodiments, the stopper surface 38 abuts the front surface 44 of the resin stopper part 40, but the present disclosure is not limited thereto, and the stopper surface may be forwardly separated from the front surface of the resin stopper part, or may be configured to abut the stopper surface depending on the degree to which the resin stopper part has moved forward.

In the above embodiments, the melt part 50 is provided on the rear surface 39 of the housing 30, but a melt part may be provided on a surface other than the rear surface of the housing (e.g., outer circumferential surface of the housing covered by the outer circumferential part of the molded part), instead of or in addition to the melt part 50

In the above embodiments, a specific shape and the like of the melt part 50 was illustrated, but the present disclosure is not limited thereto, and the shape and the like of the melt part can be changed, and, for example, the melt part need not be provided twofold, and may have a shape that individually surrounds the openings.

The invention claimed is:

1. A waterproof structure for a multicore wire, comprising:

a multicore wire in which a plurality of core wires are housed in a sheath;

a housing in which is housed a terminal fitting connected to a terminal portion of the core wires, the housing including a tower part, the tower part being a cylindrical member having a through hole so as to define an opening through which the core wires are externally extracted;

a molded part covering the opening and covering an end face of the sheath, the molded part including an outer circumferential part spaced apart from and concentric to an inner circumferential part so as to define a circumferential slit, the tower part inserted into the circumferential slit; and a resin stopper part disposed on an inner side of the molded part inside the opening.

2. The waterproof structure for a multicore wire according to claim 1, wherein a melt part formed on an outer edge of the tower part and seated within the circumferential slit, the melt part configured to melt during molding of the molded part.

3. The waterproof structure for a multicore wire according to claim 1, wherein the molded part includes a bent part that holds the multicore wire in a bent shape.

4. The waterproof structure for a multicore wire according to claim 1, wherein the outer circumferential part covers an outer circumferential surface of the housing.

5. The waterproof structure for a multicore wire according to claim 1, wherein the resin stopper part is an existing rubber plug.

6. The waterproof structure for a multicore wire according to claim 5, wherein a stopper surface opposing a surface on an inner side of the resin stopper part is formed in the housing.

7. The waterproof structure for a multicore wire according to claim 2, wherein the molded part includes a bent part that holds the multicore wire in a bent shape.

8. The waterproof structure for a multicore wire according to claim 2, wherein the outer circumferential part covers an outer circumferential surface of the housing.

9. The waterproof structure for a multicore wire according to claim 3, wherein the molded part includes an outer circumferential part covering an outer circumferential surface of the housing.

10. The waterproof structure for a multicore wire according to claim 2, wherein the resin stopper part is an existing rubber plug.

11. The waterproof structure for a multicore wire according to claim 3, wherein the resin stopper part is an existing rubber plug.

12. The waterproof structure for a multicore wire according to claim 4, wherein the resin stopper part is an existing rubber plug.

* * * * *